US005893811A

United States Patent [19]

Stover et al.

[11] Patent Number: 5,893,811

[45] Date of Patent: Apr. 13, 1999

[54] FOOTBAG WITH TAIL

[76] Inventors: Nathanial H. Stover, 2124 NW. Flanders #7, Portland, Oreg. 97210; Cole E. Larner, 3115 SW. Cascade Dr., Portland, Oreg. 97205

[21] Appl. No.: 08/592,762

[22] Filed: Jan. 26, 1996

[51] Int. Cl.[6] ..... A63B 37/00

[52] U.S. Cl. ..... 473/575; 473/576; 473/573; 473/594; 273/415; 273/58 R; 273/58 A; 273/58 K; 273/318; 273/428

[58] Field of Search ..... 273/415, 58 R, 273/58 A, 58 K, 318, 428; 473/575, 576, 573, 594

[56] References Cited

U.S. PATENT DOCUMENTS

| | | | |
|---|---|---|---|
| 3,091,460 | 5/1963 | Maldonado | 273/318 X |
| 3,393,911 | 7/1968 | Lawson | 273/428 |
| 3,937,470 | 2/1976 | Stalberger, Jr. et al. | 273/415 |
| 4,088,319 | 5/1978 | Clarke | 273/58 R |
| 4,151,994 | 5/1979 | Stalberber, Jr. et al. | 273/58 A |
| 4,354,679 | 10/1982 | Steinmetz | 273/58 A |
| 4,717,158 | 1/1988 | Pennisi | 273/58 A |
| 4,826,179 | 5/1989 | Callaghan | 273/428 |
| 4,943,066 | 7/1990 | Lathim et al. | 273/415 |
| 5,310,194 | 5/1994 | Scheel | 273/415 |

*Primary Examiner*—William H. Grieb

*Attorney, Agent, or Firm*—Kolisch, Hartwell, Dickinson, McCormack & Heuser

[57] ABSTRACT

A footbag includes a bag portion and an appendage attached to the bag portion. The appendage may be provided in many different shapes and configurations for making the footbag easier to see and play with.

11 Claims, 7 Drawing Sheets

Cosmic Kick or Cyber Kick
Tail fin variations
Three or four triangular panels of fabric dependant upon total number of panels per ball.

1.25" - 3" diameter sphere

Fin is cut with a bias.
Ball: 2" diameter
Fin: 6" length

FOOTBAG WITH TAIL

FIELD OF THE INVENTION

This invention relates to recreational devices and, in particular, to improvements to the footbag which make the device inviting and easy to play, particularly to those first learning.

BACKGROUND OF THE INVENTION

Object of the game; The object of footbag is simple: to keep the bag in the air as long as possible, using only one's feet, legs. However, doing just that isn't so simple. Some individuals aren't able to react and angle their foot or leg in time in order to make accurate contact with the footbag, thereby experiencing frustration as the footbag awkwardly recoils off their limb and away from the area of play. There is also the frustration of not being able to make contact with the footbag at all because it moves about so fast.

Prior art that specifically embodies footbags include: U.S. Pat. Nos. 3,091,460, 3,937,470, 4,151,994, 4,354,679 and 4,717,158. Each patent discloses information concerning certain/various types of construction and the overall function of the footbag. However, none of the prior art stated above discloses a permanent appendage to be a necessary part of the whole.

Related prior art that has a bag filled with particulate matter and an appendage includes U.S. Pat. No. 4,943,066 and 5,310,194. Both of these, however, could not be used in the sport of footbag because they are too heavy and floppy to kick. Furthermore, they do not claim to be used as a footbag but instead are used for light manual tossing and catching and a projectile device to be centrifugally launched, respectively. No prior art makes reference to or establishes attaching a permanent highly visible appendage to a footbag for the purpose of inviting, improving and making a footbag easier to use.

SUMMARY OF THE INVENTION

Objectives and Advantages

It is an objective that this is a new and improved footbag with a highly visible appendage integrally attached to the footbag.

The conventional footbag is difficult to see, kick and control. It is an objective of this invention to modify a footbag to make it easier to see, kick and control by an individual of virtually any skill, strength or coordination.

It is an objective that because the device is inviting and easy, beginners and the less coordinated will attempt to play and will be less likely to give up interest in it, opposed to a conventional footbag.

It is an objective that attaching a bright visible tail helps one better eye track in the direction of the device when it is rolling on the ground or in flight. Since the device will be easier to see, one can better anticipate making contact with the footbag. One will be able to mentally calculate the path of the device and then make the necessary physical extensions to connect their body to footbag.

Trailing the device in flight sometimes involves the use of peripheral vision. The tail helps to utilize and increase ones peripheral vision skills. Good peripheral vision can help a person react more intelligently in situations that are critical to life.

It is an objective that this device can be used to expand one's peripheral boundaries and awareness as well.

It is an objective that when the device is in flight the appendage is affected by aerodynamic forces; these forces are transferred from the tail to the footbag causing the device as a whole to have a predictable and stable flight pattern.

It is an objective that the appendage provides slight drag and directional stability while the device is in flight.

It is also an objective that the appendage provides slight drag and directional stability this allows an individual more time to position and angle their leg, knee or foot so as to make accurate contact with the footbag.

It is also an objective that attaching a tail to a footbag cooperates to provide a more stimulating game.

Another object of the invention is to produce a ball and tail combination such that the tail is configured to slow down the speed of the ball.

PRIOR ART

In no prior art has it been established or disclosed to attach a permanent appendage to a footbag (specific dimensions of what constitutes a footbag) for the purpose of inviting, improving, and making a footbag easier to use.

The flutter and fishtailing motion of the tail while in flight provides visual attractiveness to players and spectators. The visual attractiveness captures one's attention. It not only encourages newcomers to play but encourages one to keep making contact with the ball so that they can watch and experience the flutter of the tail. The attractiveness of the tail helps maintain one's interest in the game and promotes continuous play, thus increasing overall one's aerobic health and mental concentration.

Because the tail provides a means of which you can see and control the object better, it brings a new dimension of competition to the arena, especially for those already skilled at the sport of footbag. It allows for players to attempt and make more challenging and exciting kicks.

It is also an objective that this device allows for players to further develop their reflexes and motor coordination skills.

It is another objective that the ball and tail are constructed in such a manner that the device will be capable of withstanding rugged and prolonged use. The tail has sufficient tensile strength so that if you simultaneously pulled the tail and ball in opposite directions, the tail would not come apart from the ball.

The type of material and the weight of the material and the method in which the tail is attached and sewn into the ball will not interfere with natural contour of the ball.

The device is constructed in such a way that if it happens to land in nearby bushes, while being played with, the appendage, will for the most part, allow the device to catch and hang on a branch so as to keep it from getting lost.

The bright visibility of the tail makes the device easily recognizable, if one were to lose sight of the ball. For example, if the device happened to land in deep grass or brush where the grass or brush permits the ball to fall/descend to the ground.

The construction and visibility of the device allow one to play in inclement weather without losing the device, e.g., mild rain or snow.

It is also an objective that the tail prohibits the device from rolling to far from play when the ball lands on the ground. This alleviates the frustration of chasing after the ball.

It is also an objective that this device can be used as a training aid. One can hold the device by the tail, allowing the footbag to hang downward, and then kick at the hanging footbag. The appendage allows the footbag to be positioned at a variety of heights and positions.

It is also an objective that using this device as a training aid can increase one's proficiency at kicking a conventional footbag.

It is also an objective, that to a certain extent, individuals undergoing leg, knee, or foot rehabilitation can make use and benefit from this device. By having someone hold the device by the tail or placing the device on a stand to create the same effect and then positioning the device at an appropriate height so as the individual can attempt to make continuous contact with the ball. Thereby extending, exercising and rehabilitating injured part of leg, knee or foot.

DESCRIPTION OF THE PREFERRED EMBODIMENTS

FIGS. 1A–1D show various views of a preferred embodiment of the invention. The footbag includes six panels which are sewn together. The tapered tail is sewn into the seam of one of the panels.

Figure 1B:
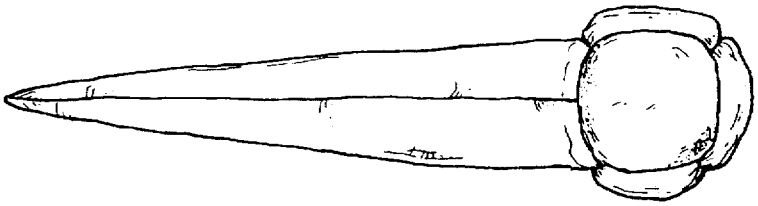
FIGS. 1–15 illustrate various forms of the invention, each design including a combination of a footbag with an appendage or "tail."
Figure 1A:
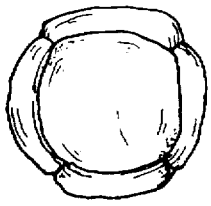
Figure 1D:
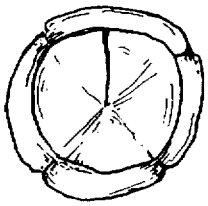
Figure 1C:
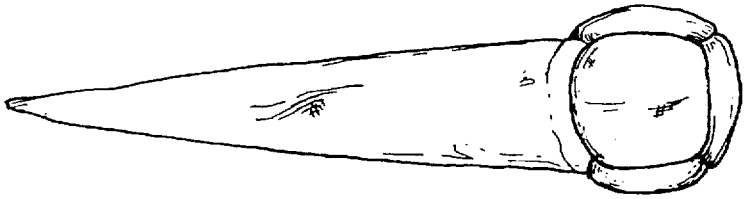
Figure 2A:
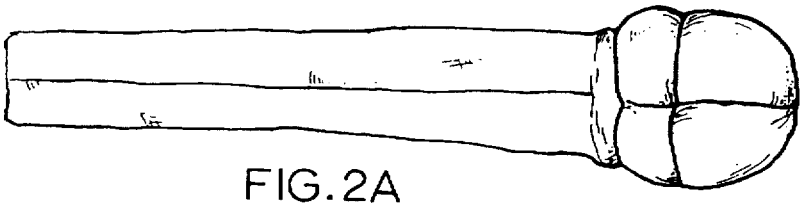
Figure 2B:
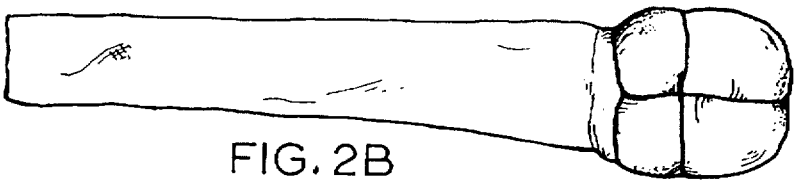
Figure 2C:
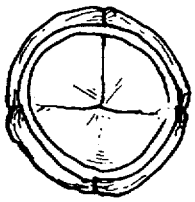
Figure 3A:
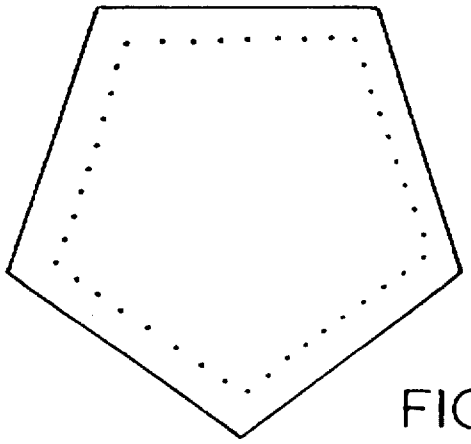
Figure 3B:
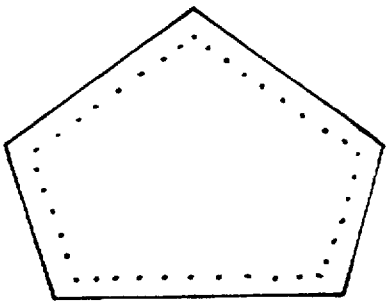
Figure 3C:
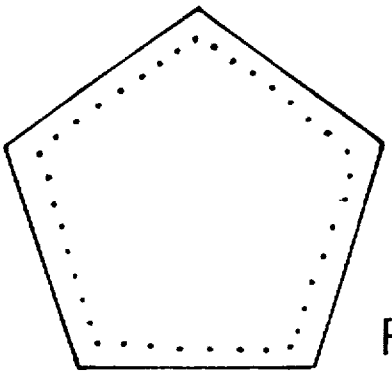
Figure 3D:
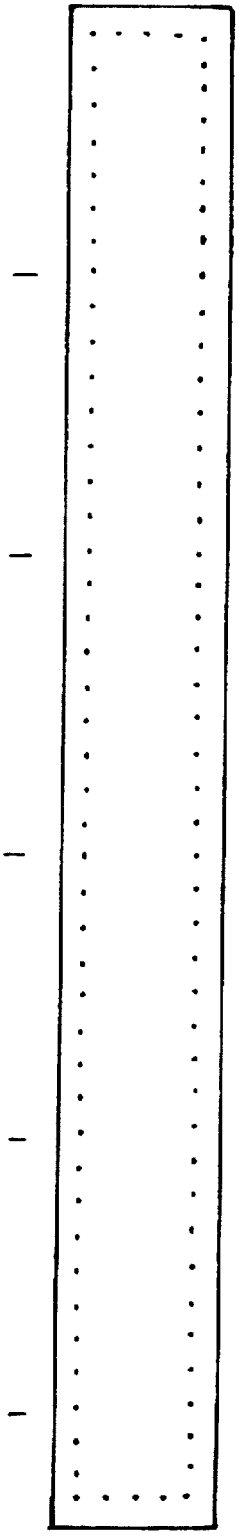

Another design is shown from three different views in FIGS. 2A–2C. In this design, the tail is less tapered and practically rectangular in shape.

FIGS. 3A–3D a set of patterns which can be used to produce a ball and tail design of the present invention.

Figure 4A:
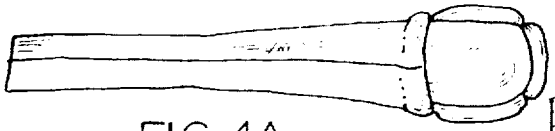
Figure 4B:
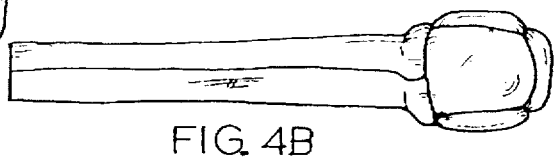
Figure 4C:
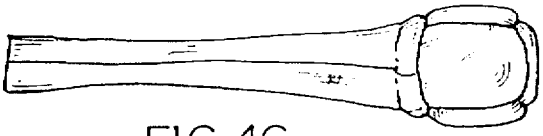
Figure 4D:
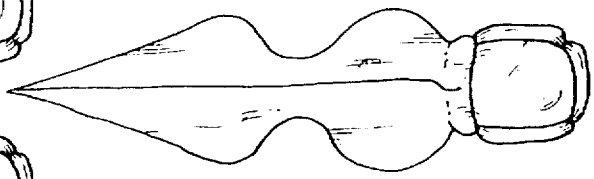
Figure 4E:
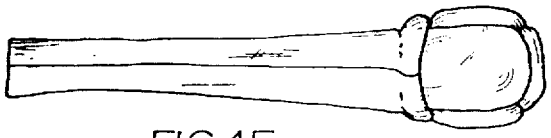
Figure 4F:
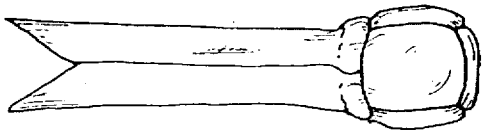
Figure 4G:
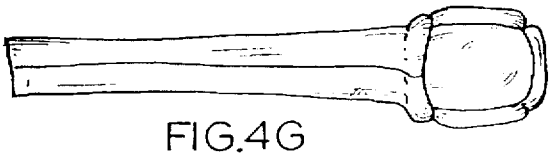
Figure 4H:
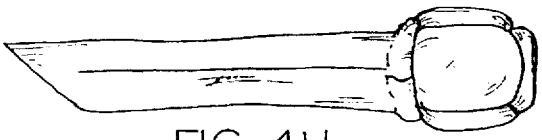
Figure 4I:
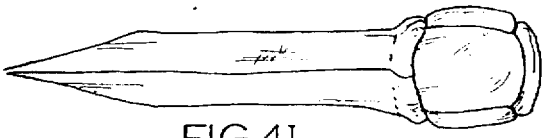
Figure 4J:
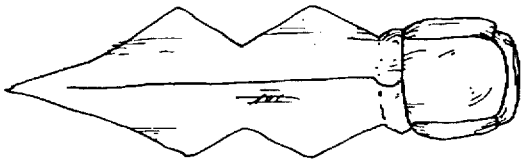
Figure 4K:
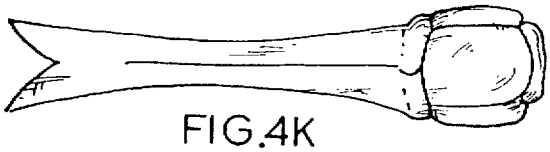
Figure 4L:
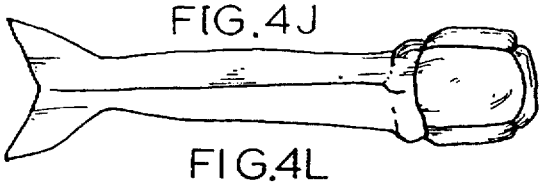
Figure 4M:
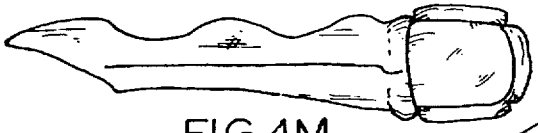
Figure 4N:
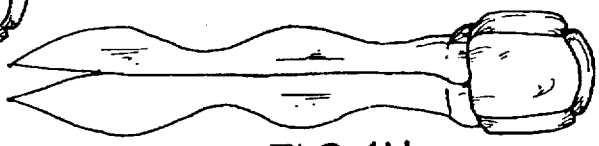

As shown in FIGS. 4A–4N, numerous different tail designs can be employed.

Figure 5B:
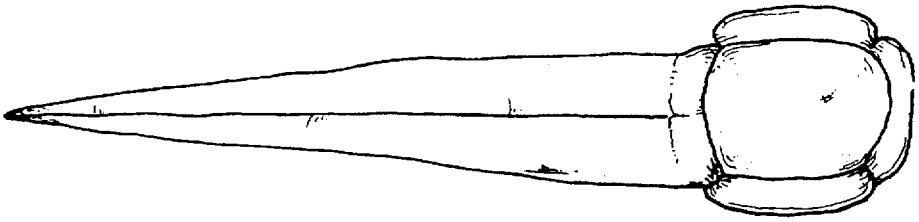
Figure 5A:
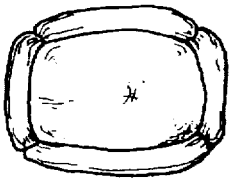
Figure 5C:
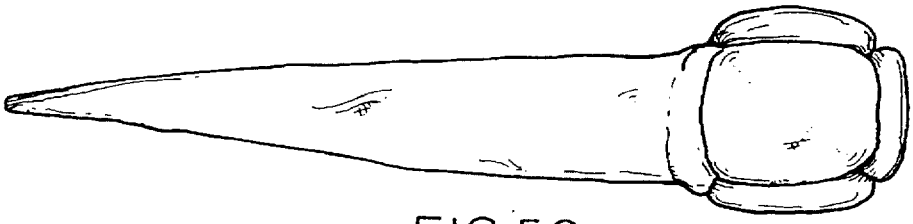

The ball shown in FIGS. 5A–5C is quite similar to ones shown in FIGS. 1A–1D except, as shown in FIG. 5A, the end panel is somewhat rectangular, giving the ball a slightly flattened shape.

Figure 6B:
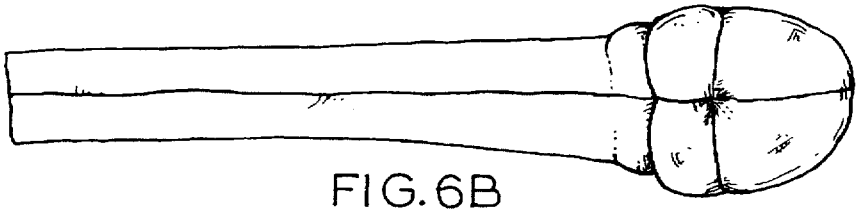
Figure 6A:
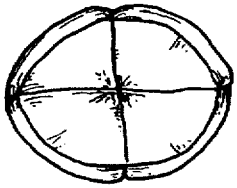
Figure 6C:
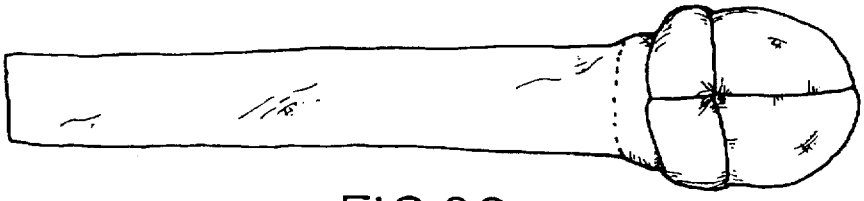
Figure 7A:
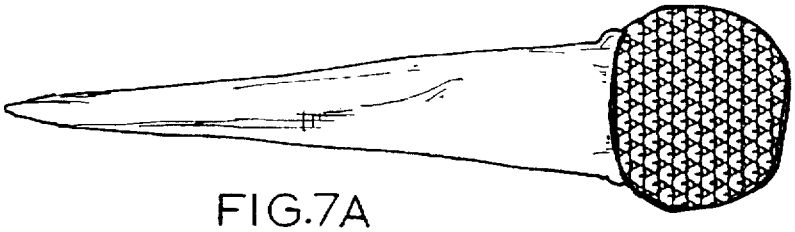
Figure 7C:
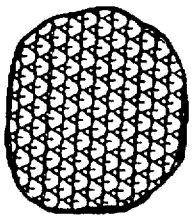
Figure 7B:
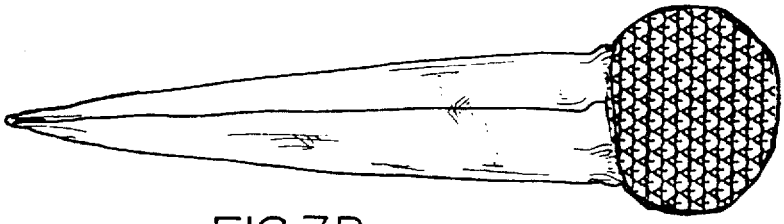
Figure 7D:
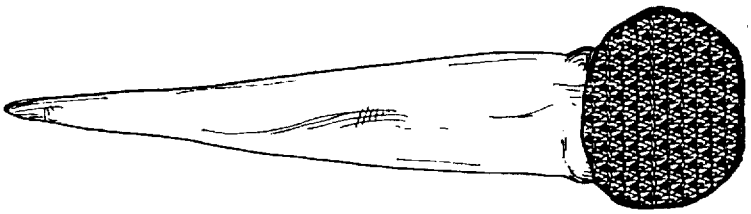
Figure 7F:
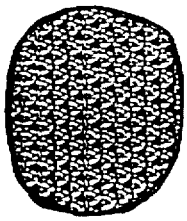
Figure 7E:
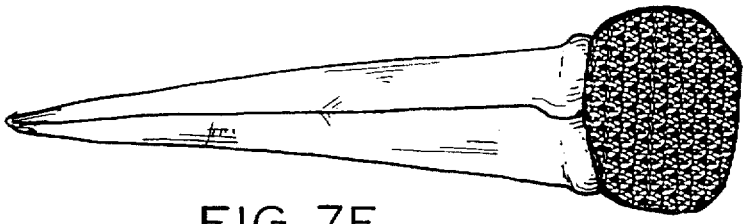
Figure 8:
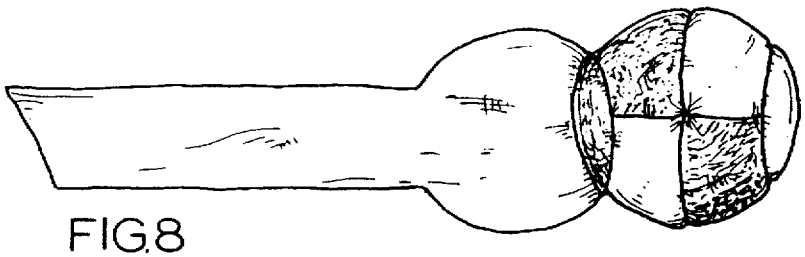
Figure 9:
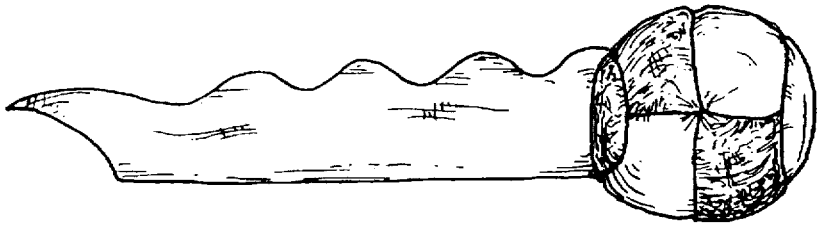
Figure 10:
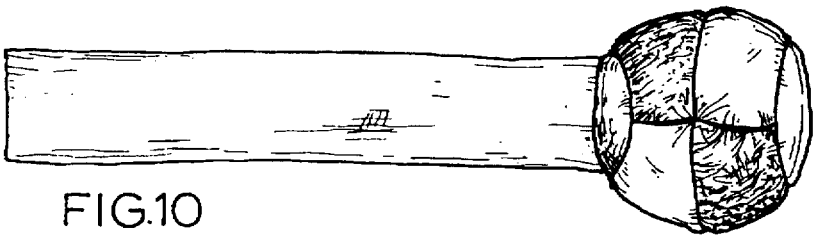
Figure 11:
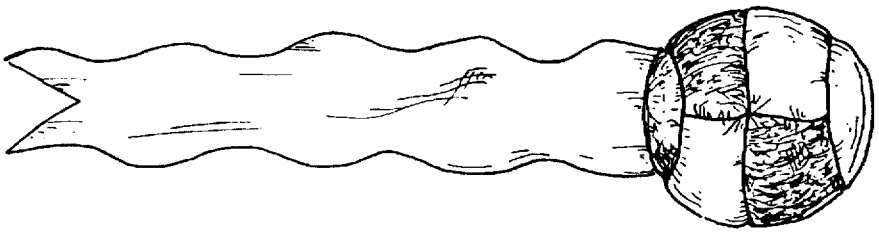
Figure 12:
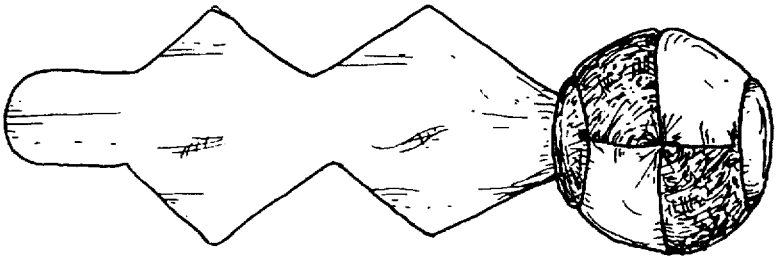
Figure 13:
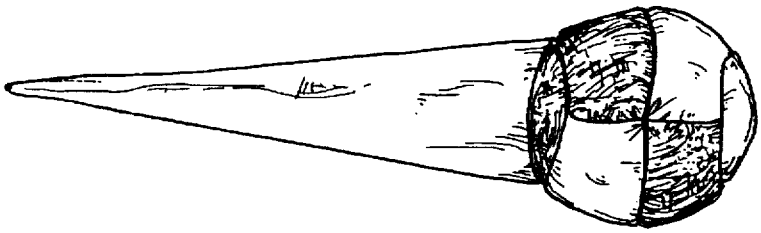
Figure 14A:
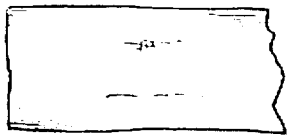
Figure 14B:
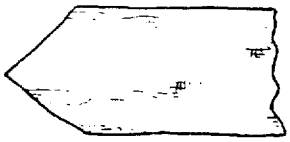
Figure 14C:
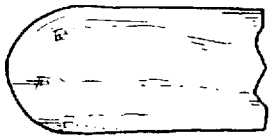
Figure 14D:
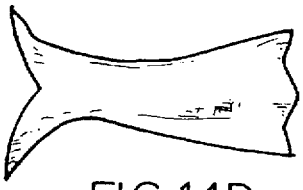
Figure 14E:
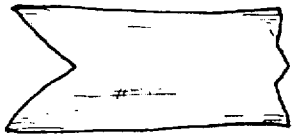
Figure 14F:
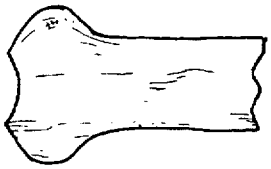
Figure 14G:
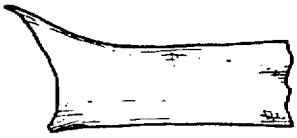
Figure 14H:
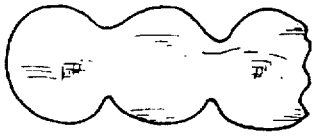
Figure 14I:
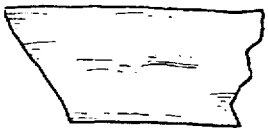

The ball shown in FIGS. 6A–6C is quite similar to the balls previously shown in FIGS. 2A–2C.

The ball shown in FIGS. 7A–7F employs a substantially spherical footbag made of a crocheted material or some other woven fabric.

Modified ball and tail designs are shown in FIGS. 8–13.

Still more possible tail designs are shown in FIGS. 14A–14I.

Figure 15:
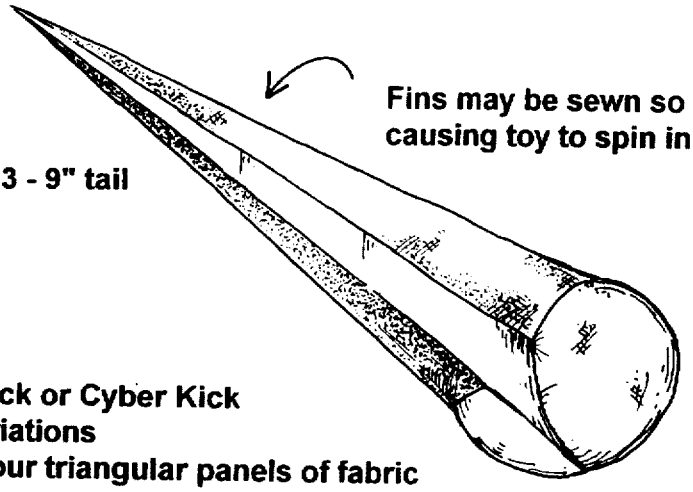

FIG. 15 shows a modified ball and tail design in which the tail has three tapered and converging fins or panels. Proximal ends of the panels are preferably sewn into seams of the footbag.

There are various dimensions and possibilities in regard to the relative disposition of the appendage: length, 4 to 7.5 inches; width, ⅛ of an inch to 4 inches. The single tail appendage can be left open (resembling a funnel) at free distal end. Or, it can be sewn closed at free distal end. It can also extend out of the ball in just a flat ribbon-like or book marker form.

The appendage can consist of one to three appendages extending from the base which would join to create a uniform appearance and function. The appendages would connect (be sewn) in the middle.

The color of the tail will be visibly distinctive indicia not limited to one color.

Specific examples of the invention are illustrated in the application. However, it will be apparent to persons skilled in the art that numerous other variations and embodiments are suggested and claimed in this invention.

I claim:

1. A footbag comprising:

a bag portion including a plurality of panels, each panel having a circumferential seam connecting it to adjacent panels, the bag portion being partially filled with material; and an appendage sewn into the circumferential seam of one of the panels.

2. The footbag of claim 1, wherein the appendage has a proximal end connected to the bag portion and a distal end, the appendage being tapered in shape from the proximal to the distal end.

3. The footbag of claim 1, wherein the appendage is substantially rectangular in shape.

4. The footbag of claim 1, wherein the appendage can have a variety of different shapes.

5. The footbag of claim 1, wherein the appendage is from 4 to 7.5 inches in length and ⅛ to 4 inches in width.

6. The footbag of claim 1 wherein said appendage contains visibly distinctive indicia.

7. The footbag of claim 1, wherein said appendage creates a fluttering or shimmering motion when said footbag is kicked.

8. The footbag of claim 1, wherein said appendage because of its visibility allows players to focus on body positioning in preparation for the next kick, no more straining to locate footbag in the air.

9. The footbag of claim 1, wherein said appendage can be constructed so that it has three tapered and converging fins.

10. The footbag of claim 1, wherein the appendage is sewn onto the outside of the bag where the panels meet.

11. A footbag comprising:

a bag portion constructed by crocheting a material such as cotton or rayon into a substantially spherical cover partially filled with particulate elements; and an appendage sewn onto the cover of the bag portion.

* * * * *